US006645434B1

(12) United States Patent
Muramatsu et al.

(10) Patent No.: US 6,645,434 B1
(45) Date of Patent: Nov. 11, 2003

(54) SAMPLE OBSERVATION PLATE AND OBSERVATION APPARATUS

(75) Inventors: Hiroshi Muramatsu, Chiba (JP); Katsunori Homma, Chiba (JP); Akira Egawa, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/512,115

(22) Filed: Feb. 24, 2000

(30) Foreign Application Priority Data

Mar. 3, 1999 (JP) ..... 11-055489
Oct. 18, 1999 (JP) ..... 11-295841

(51) Int. Cl.[7] ..... B01L 3/00

(52) U.S. Cl. ..... 422/102; 422/99; 422/104; 435/283.1; 435/287.1; 435/287.9; 435/288.3; 356/36; 356/38

(58) Field of Search ..... 422/50, 55, 82.05, 422/82.06, 82.11, 99, 102, 104; 435/4, 7.1, 7.2, 283.1, 287.1, 287.9, 288.2, 288.3, 288.4, 288.7; 356/36, 37, 38

(56) References Cited

U.S. PATENT DOCUMENTS 4,011,350 A * 3/1977 Markovits et al. ..... 427/2
4,231,660 A * 11/1980 Remy et al. ..... 356/244
4,705,705 A * 11/1987 Bross ..... 428/13
5,479,024 A * 12/1995 Hillner et al. ..... 250/458.1
5,985,551 A * 11/1999 Brennan ..... 435/6
6,001,556 A * 12/1999 Charych et al. ..... 435/5
6,103,479 A * 8/2000 Taylor ..... 435/7.2
6,121,048 A * 9/2000 Zaffaroni et al. ..... 436/45
6,284,310 B2 * 9/2001 Picard ..... 427/180

* cited by examiner

*Primary Examiner*—Jill Warden
*Assistant Examiner*—Dwayne K Handy
(74) *Attorney, Agent, or Firm*—Adams & Wilks

(57) ABSTRACT

A sample observation plate is provided which is smooth in a surface in molecular levels and cheap in price, thereby making feasible topological and optical observation in molecular levels. In a sample observation plate to be used on an apparatus for observation of topological and optical information in molecular levels, the sample observation plate is structured by bonding a crystalline thin film on a glass plate. Furthermore, using this sample observation plate, an observation apparatus is structured.

30 Claims, 4 Drawing Sheets

SAMPLE OBSERVATION PLATE AND OBSERVATION APPARATUS

BACKGROUND OF THE INVENTION

This invention relates to a sample observation plate and to an observation apparatus which are used in conducting observation and analysis of a biological sample or an organic sample in molecular levels.

In conducting observation of DNA or the like in molecular levels by using a probe microscope, Mica, HOPG, a glass plate or the like has been used. Among these, mica and HOPG have extremely smooth surfaces. However, at the same time they are difficult to use to conduct optical transmission observation due to their low optical transmissivity. Meanwhile, there has been a problem in that a glass plate is insufficient in smoothness. On the other hand, although there is a method of using a sapphire substrate, a problem exists of cost.

SUMMARY OF THE INVENTION

It is an object of the present invention to provide a sample observation plate which has a smooth surface on atomic levels, and which is capable of use for conducting transmission type optical observation but is cheap in price, and to an an observation apparatus using such a sample observation plate, thereby enabling topological and optical observation on molecular levels.

In order to solve the above problem, a sample observation plate was devised having a crystalline thin film such as of mica bonded on a transparent substrate such as a glass plate. This utilizes an fact that the extremely thin crystalline thin film possibly does not cause a problem with light transmission and scattering, and solves the problem by supporting the thin film on the glass substrate. Furthermore, a sample observation plate is devised having a frame printed on a mica surface thereof, in order to enable observation of a plurality of samples at one time.

DETAILED DESCRIPTION OF THE PREFERRED EMBODIMENT

A sample observation plate, according to the present invention will now be described with reference to the drawings.

Figure 1:
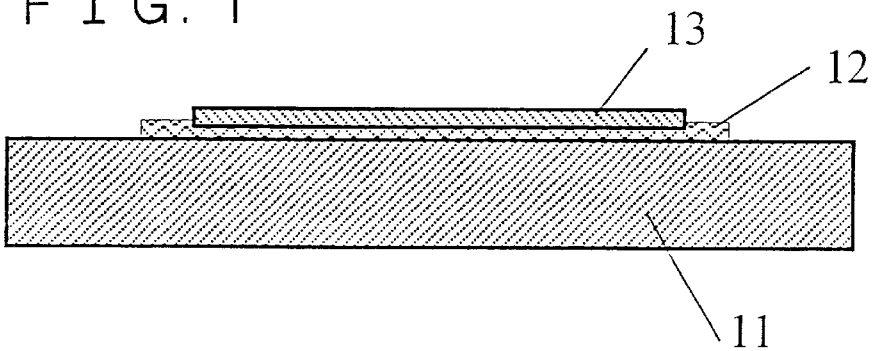
FIG. 1 is a figure showing a structure of a sample observation plate according to an embodiment of the present invention.

Referring to FIG. 1, a sample observation plate of the invention is illustrated in structure including a glass plate 11 as a transparent substrate, an adhesive 12 and a crystalline thin film 12 such as a mica thin film or the like. The close contact of the crystalline thin film at its backside with the glass through the adhesive makes it possible to conduct microscope observation at a surface of the crystalline thin film through the glass. The adhesive in this case is most desirably formed of a material that does not give off fluorescent light upon conducting fluorescence observation, and a cyanoacrylate adhesive is suitably used.

Figure 2:
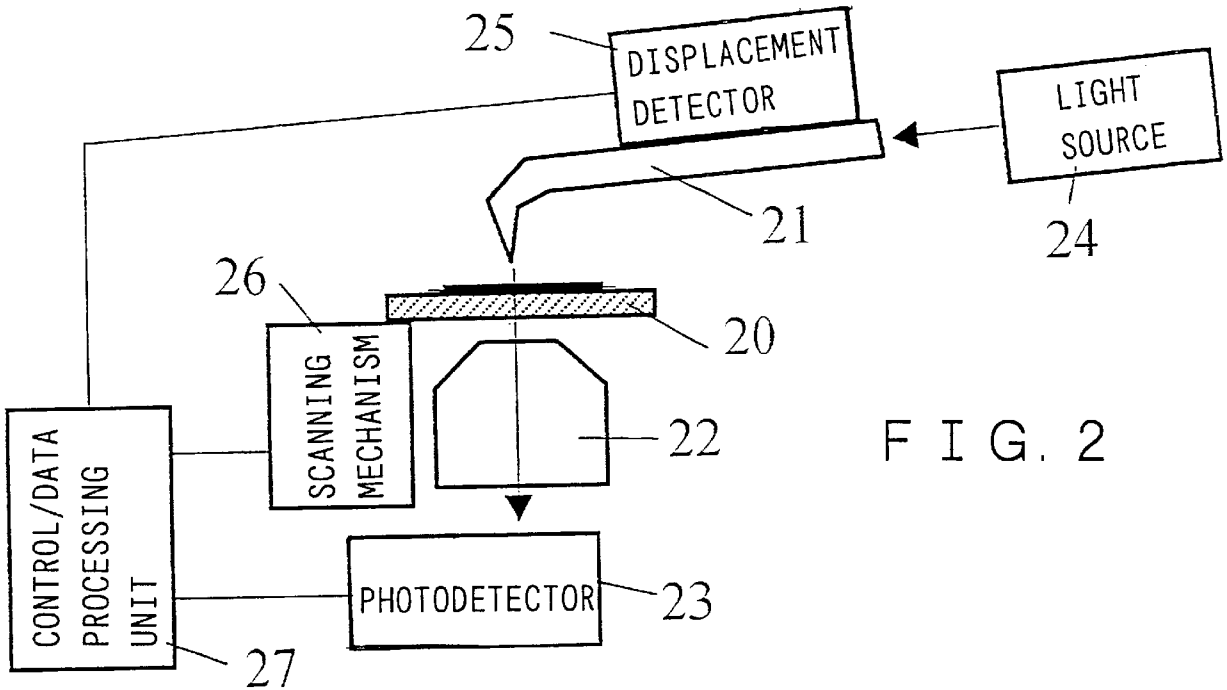
FIG. 2 is a typical view showing an embodiment of a scanning near-field optical microscope for an observation apparatus according to the invention.

The sample observation plate is usable in a scanning near-field optical microscope, as shown in FIG. 2. In FIG. 2, the scanning near-field optical microscope is structured by an optical probe 21, for undergoing relative scanning relative to the sample while irradiating the sample with light an objective lens 22, for focusing light emitted by the sample in response to irradiating by the probe and producing a focused light a photodetector 23, for detecting the focused light and producing a corresponding electrical signal a light source 24, or emitting light into the optical probe a displacement detector 25, for detecting displacement of the probe during scanning thereof relative to the sample a scanning mechanism 26, for causing relative scanning movement of the probe relative to the sample a control/data processing unit 27 for determining a characteristic of the sample based on displacement of the probe detected by the displacement detector and so on, besides the sample observation plate 20.

Figure 3:
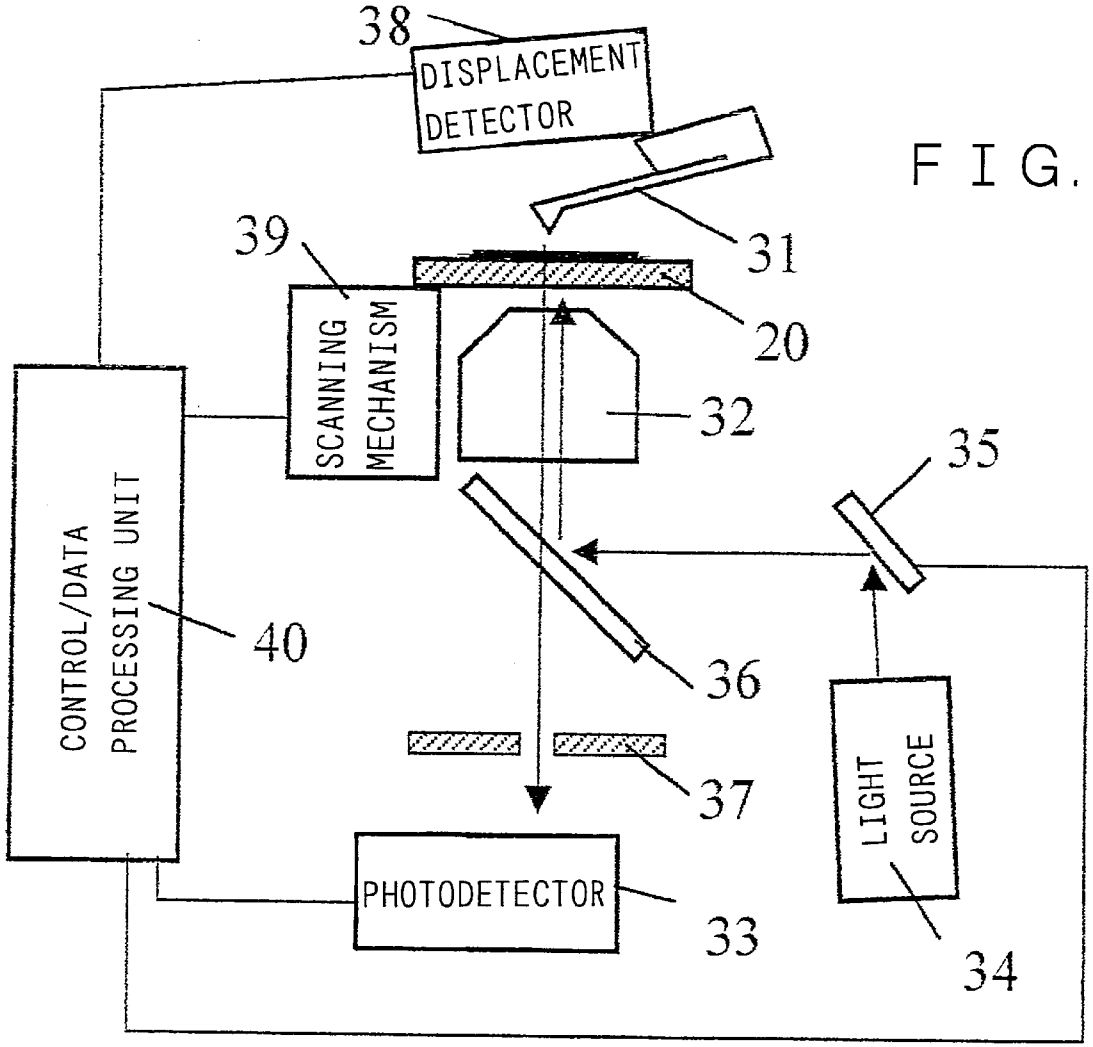
FIG. 3 is a view showing an observation apparatus of an atomic force microscope and confocal microscope coupled type.

Referring to FIG. 3, an atomic-and-confocal microscope coupled observation apparatus is structured by a probe 31, an objective lens 32, a photodetector 33, a light source 34, a galvano-mirror 35, a dichroic mirror 36, a pinhole 37, a displacement detector 38, a scanning mechanism 39, a control/data processing unit 40 and so on, besides a sample observation plate 20.

These observation apparatuses are suited for topological and optical observations on DNA, protein or the like in molecular levels.

Incidentally, the transparent substrate can use various materials, including various glass substrates such as a borosilicate glass and a quartz glass and a quartz plate. It should, however, be noted that where conducting fluorescence observation, a substrate small in fluorescent light occurrence is preferable. The usually used cover glass has a thickness of nearly 0.17 mm, and a mica plate of about 0.01 mm is to be readily prepared the crystalline thin film preferably has a thickness of 0.05 mm or less.

Accordingly, it is possible for the sample observation plate to make the total thickness of the glass plate and the crystalline thin film equal to or smaller than 0.25 mm. This makes possible to use an oil-immersed or water-immersed type objective lens of an inverting microscope.

Figure 4B:
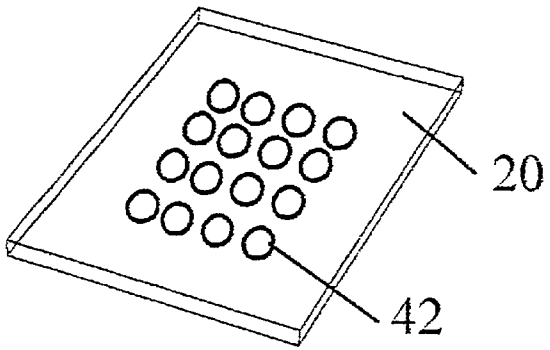
FIGS. 4A and 4B are views showing a sample observation plate having a frame printed on a mica surface of the invention.
Figure 4A:
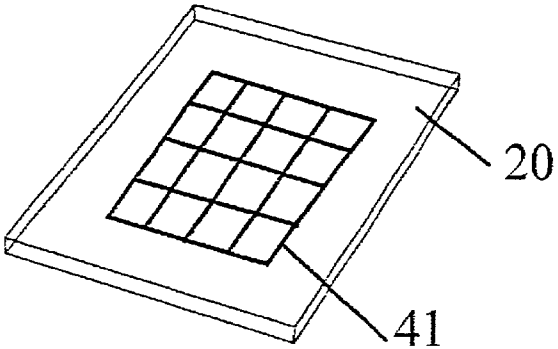
Figure 5B:
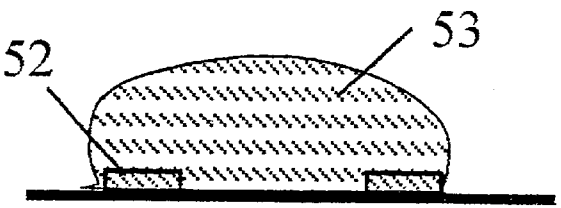
FIGS. 5A and 5B are views showing the manner in which a liquid is held on a frame structure of the invention.
Figure 5A:
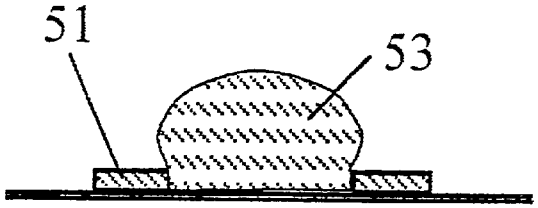

In order to enable the simultaneous observing of a plurality of samples, a sample observation plate can be made to have a frame printed on a mica surface thereof. FIGS. 4A and 4B illustrate frame print examples wherein shown are a lattice-formed frame 41 and a ring-formed frame 42. When a liquid containing a sample is dripped onto the frame, where the frame 51 is hydrophobic, the liquid 53 is held as shown in FIG. 5A. Where hydrophobic treatment is made for the mica and the frame 52 is hydrophilic in material, the liquid 53 is held as shown in FIG. 5B. Sample observation is made with the liquid is dried, or by removing the liquid when the sample material is adsorbed or bound on the mica surface.

Here, the hydrophilic frame can be formed of a material such as polyvinyl alcohol, cellulose acetate or polyamide. The hydrophobic frame can be formed of a material such as polyethylene, polypropylene, fluoroplastic or silicone resin.

Polymerization is performed after printing, or printing is made by dissolution in a solvent. Adhesion can be increased by heating after printing. Meanwhile, where hydrophilic treatment is made on the mica surface, a silane coupling agent can be used.

A plurality of micro-cells can be formed by providing a plurality of such frames. For example, if various DNA probes are previously adsorbed in the individual frames to which a DNA sample to be tested is added, then it is possible to simultaneously examine on one sample observation plate whether there is a corresponding sequence to the DNA probe in the DNA to be tested by a topological or optical technique. Also, if a chromosome is previously adsorbed and a DNA probe is acted thereon, it is possible to identify a presence and position of various DNA sequences in the chromosome due to a combination of a topological and optical techniques. By making a plurality of frames, it is satisfactory to slightly slide an observation position without requiring exchange of the sample observation plate. Thus, efficiency of observation is greatly improved.

Meanwhile, the frame can be made, for example, approximately 200 $\mu$m in width. In this case, one hundred cells can be formed within a 2-mm square. Naturally, it is possible to form a smaller or greater number of cells than those.

Figure 6:
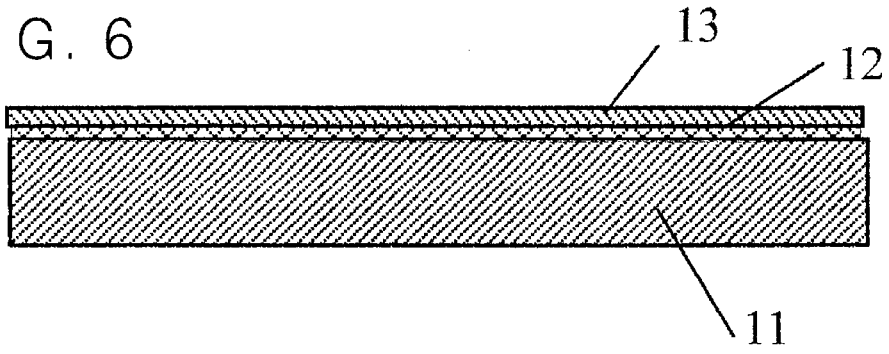
FIG. 6 is a figure showing the structure of a sample observation plate according to an embodiment of the present invention.
Figure 7:
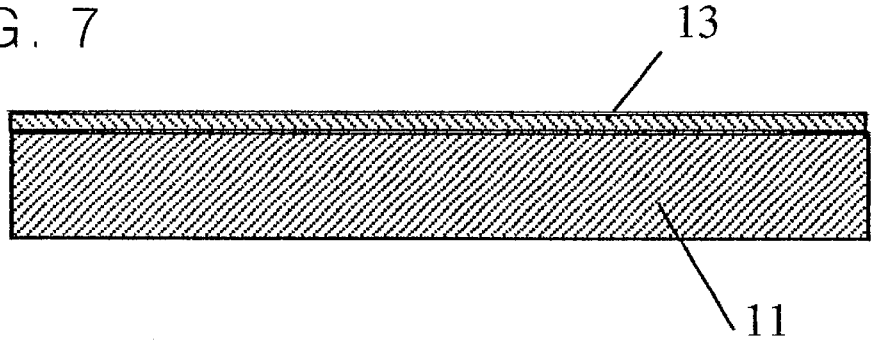
FIG. 7 is a figure showing the structure of a sample observation plate according to an embodiment of the present invention.

On the other hand, the glass plate and the crystalline thin film, if formed with their outer periphery substantially aligned as shown in FIG. 6, makes it easy to handle the sample observation plate. Also, other bonding methods than adhesion are possible to employ. For example, an interface bonding technique such as heating pressure bonding or anodic bonding can provide bonding with greater strength. In this case, no adhesive is required as shown in FIG. 7. Besides, it is possible to use a vacuum seal method in which a glass substrate and a crystalline thin film are closely contacted in vacuum to seal an outer peripheral portion with an adhesive or the like.

In this manner, the bonding without using an adhesive provides an effect of reducing background florescence.

Figure 8:
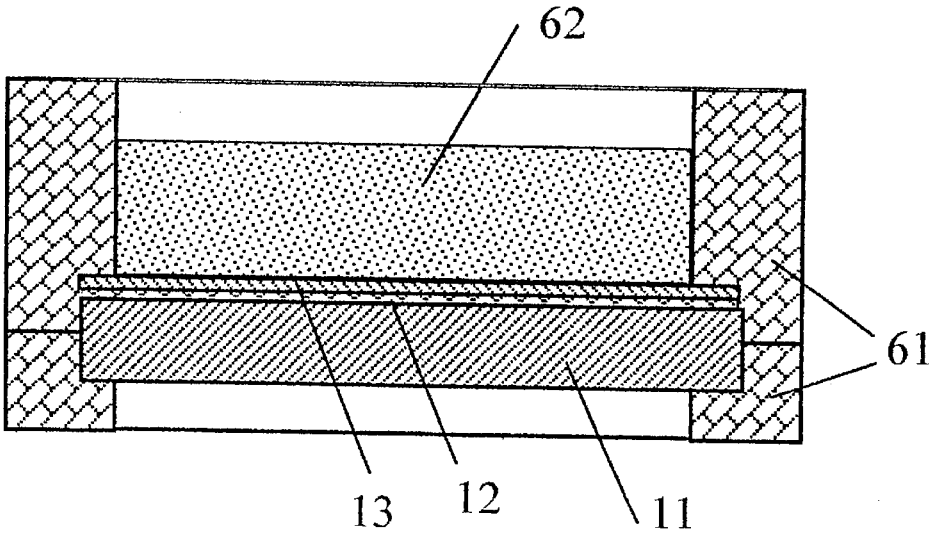
FIG. 8 is a figure showing the structure of a sample observation plate according to an embodiment of the present invention.

Furthermore, where treatment is made by a liquid or observation is done in a liquid, the provision of an edge 61 as shown in FIG. 8 enables to sustain the liquid 62 on the crystalline thin film. In this manner, the provision of an edge at an outer periphery of the sample observation plate same in the outer periphery can prevent the liquid from infiltrating into a bonding portion. The use of an agent-resistant material in this edge enables to treat a surface of the crystalline thin film with an organic solvent, acid or alkali.

Incidentally, in the case that mica is used for the crystalline thin film, reuse is possible by removing the outermost layer with using an adhesive tape.

By the sample observation plate of the invention, a sample observation plate was realized which is smooth in a surface in atomic levels, capable of transmission type optical observation but cheap in price. Topological and optical observations are made possible to simultaneously perform in molecular levels by the observation apparatus.

What is claimed is:

1. A sample observation plate for use with an oil-immersed or water-immersed objective lens of an inverting microscope which is used for observation of topological and optical features of a sample on a molecular level, the sample observation plate comprising: a transparent substrate; and a crystalline thin film formed of a thin crystalline sheet of mica, the crystalline sheet being adhered to the transparent substrate for supporting the sample; wherein an overall thickness of the transparent substrate and the crystalline sheet is 0.25 mm or less.

2. A sample observation plate according to claim 1; wherein the transparent substrate comprises a glass plate.

3. A sample observation plate according to claim 1; further comprising a frame formed on a surface of the crystalline thin film for holding the sample.

4. A sample observation plate according to claim 1; wherein the frame comprises a plurality of frames arranged in a lattice form.

5. A sample observation plate according to claim 1; wherein the frame comprises a plurality of ring-shaped frames.

6. A sample observation plate according to claim 1; wherein the frame is hydrophilic.

7. A sample observation plate according to claim 1; wherein the frame is hydrophobic.

8. A sample observation plate according to claim 1; further comprising a cyano-acrylate adhesive agent for bonding the crystalline thin film to the transparent substrate.

9. A sample observation plate according to claim 1; wherein the crystalline thin film is bonded to the transparent substrate by an interface bonding method.

10. A sample observation plate according to claim 8; wherein the interface bonding method comprises a heating pressure bonding method.

11. A sample observation plate according to claim 8; wherein the interface bonding method comprises anodic bonding.

12. A sample observation plate according to claim 1; wherein the crystalline thin film is bonded to the transparent substrate by a vacuum sealing method.

13. A sample observation plate according to claim 1; wherein peripheral surfaces of the glass plate and the crystalline thin film are aligned.

14. A sample observation plate according to claim 11; further comprising a sidewall formed on a peripheral edge of the transparent substrate for holding a liquid on the crystalline thin film.

15. An apparatus for observing topological and optical information on a molecular level, comprising: a sample observation plate according to claim 1 for holding a sample; an optical probe for undergoing relative scanning with respect to the sample while irradiating the sample with light; an objective lens for focusing light emitted by the sample in response to irradiation by the probe and producing a focused light; a photodetector for detecting the focused light and producing a corresponding electrical signal; a light source for emitting light into the probe; a displacement detector for detecting displacement of the probe during the scanning movement thereof relative to the sample; a scanning mechanism for causing relative scanning movement of the probe relative to the sample; and a control/data processing unit for determining a characteristic of the sample based on displacement of the probe detected by the displacement detector.

16. An apparatus for observing topological and optical information on a molecular level, comprising: a sample observation plate according to claim 1 for holding a sample; a probe for undergoing relative scanning movement with respect to the sample; an objective lens for focusing a projected light and producing a focused projected light for irradiating the sample, and for focusing a light produced by the sample in response to irradiation thereof and producing a focused reflected light; a photodetector for detecting the focused reflected light and producing a corresponding electrical signal; a light source for producing the projected light; a galvano-mirror for directing light from the light source; a dichroic mirror for receiving light from the galvano-mirror and directing it to the objective lens, and for directing the focused reflected light to the photodetector; means defining a pin hole disposed between the dichroic mirror and the photodetector; a displacement detector for detecting displacement of the probe during the scanning movement thereof relative to the sample; a scanning mechanism for causing relative scanning movement of the probe relative to the sample; and a control/data processing unit for determining a characteristic of the sample based on displacement of the probe detected by the displacement detector.

17. A sample observation plate according to claim 1; further comprising an adhesive for bonding the crystalline thin film to the transparent substrate.

18. A sample observation plate according to claim 17; wherein the adhesive is formed of a material which does not emit fluorescent light.

19. A sample observation plate according to claim 1; wherein the transparent substrate comprises one of borosilicate glass and quartz.

20. A sample observation plate according to claim 1; wherein the transparent substrate is formed of a material which produces little or no fluorescent light.

21. A sample observation plate according to claim 1; wherein the transparent substrate has a thickness of about 0.17 mm.

22. A sample observation plate according to claim 1; wherein the crystalline thin film has a thickness of about 0.01 mm.

23. A sample observation plate according to claim 6; wherein the frame is formed of one of polyvinyl alcohol, cellulose acetate and polyamide.

24. A sample observation plate according to claim 7; wherein the frame is formed of one of polyethylene, polypropylene, fluoroplastic and silicone resin.

25. A sample observation plate for use with an oil-immersed or water-immersed objective lens of an inverting microscope, comprising: a support substrate; and a crystalline thin film formed of a crystalline sheet of mica disposed on the support substrate; wherein an overall thickness of the support substrate and the crystalline sheet is 0.25 mm or less.

26. A sample observation plate according to claim 25; wherein the support substrate is transparent.

27. A sample observation plate according to claim, 25; further comprising an adhesive agent for bonding the at crystalline thin film to the substrate.

28. A sample observation plate according to claim 27; wherein the adhesive agent is a cyano-acrylate adhesive agent.

29. A sample observation plate according to claim 25; wherein the crystalline thin film is bonded to the substrate without an adhesive.

30. A sample observation plate according to claim 1; wherein the crystalline sheet has a thickness of 0.05 mm or smaller.

* * * * *